US005478984A

United States Patent [19]

Bouleau et al.

[11] Patent Number: 5,478,984

[45] Date of Patent: Dec. 26, 1995

[54] STEAM IRON WITH THERMAL SHIELD SECURED TO THE SOLE AND PROCESS FOR THE SECUREMENT OF SUCH THERMAL SHIELD ON THE SOLE

[75] Inventors: Jean-Paul A. A. Bouleau, Champfleur; Gerard L. H. Guillot, Radon, both of France

[73] Assignee: Moulinex (Societe Anonyme), Bagnolet, France

[21] Appl. No.: 231,301

[22] Filed: Apr. 22, 1994

[30] Foreign Application Priority Data

Apr. 23, 1993 [FR] France ..... 93 04851

[51] Int. Cl.[6] ..... D06F 75/14

[52] U.S. Cl. ..... 219/254; 219/256; 219/245; 38/74

[58] Field of Search ..... 219/254, 256, 219/245; 38/82, 77.1–79

[56] References Cited

U.S. PATENT DOCUMENTS

| | | | |
|---|---|---|---|
| 1,472,762 | 10/1923 | Moore | 219/254 |
| 2,914,646 | 11/1959 | Denton | 219/254 |
| 3,369,103 | 2/1968 | Turner | 219/254 |

FOREIGN PATENT DOCUMENTS

| | | | |
|---|---|---|---|
| 0549333 | 6/1993 | European Pat. Off. . | |
| 2-111395 | 4/1990 | Japan | 38/77.83 |
| 554567 | 7/1943 | United Kingdom | 38/77 |
| 2158105 | 11/1985 | United Kingdom . | |

*Primary Examiner*—John A. Jeffery
*Attorney, Agent, or Firm*—Young & Thompson

[57] ABSTRACT

Pressing iron comprising a casing (1), a pressing sole (2) comprising a heating resistance (3) which is embedded in the sole (2) and whose ends (4, 5) project from the upper surface of the sole (2) in the rear region of the iron. A thermal shield (7) is interposed between the upper surface of the sole and the casing, and is maintained on the sole by fasteners. Securement structure of the thermal shield (7) comprises, in the forward portion of the sole, an anchoring member (9) for the shield (7) to the sole (2) and, in the rear portion of the sole, a hooking device (10) for the shield (7) on the projecting ends (4, 5) of the resistance (3).

10 Claims, 4 Drawing Sheets

STEAM IRON WITH THERMAL SHIELD SECURED TO THE SOLE AND PROCESS FOR THE SECUREMENT OF SUCH THERMAL SHIELD ON THE SOLE

FIELD OF THE INVENTION

The invention relates to pressing irons comprising a casing, a pressing sole comprising a heating resistance which is embedded in the sole and whose ends project from the upper surface of said sole in the rear region of the iron, as well as a thermal shield interposed between said upper surface of the sole and the casing, and maintained on said sole by securement means.

BACKGROUND OF THE INVENTION

In known pressing irons, the sole is of one cast piece generally of aluminum and the securement means are constituted by several screws which pass through the thermal shield and which are secured, either to tapped recesses provided in the sole, or with metallic tongues riveted or seated in the sole.

The drawback of using such securement means resides in the supplemental machining operations of the sole and in the increase of the number of pieces on the upper surface of the sole, given that this surface is small and receives the electrical connections. Moreover, these machining operations and these supplemental pieces require operations that cannot be automated and which raise the price of these soles.

SUMMARY OF THE INVENTION

The invention has for its object to overcome these drawbacks and to provide an assembly of the shield on the sole which will be simple and economical.

According to the invention, the securement means of the thermal shield comprise, in the forward portion of the sole, an anchoring member for the shield on the sole and, in the rear portion of the sole, a device for hooking the shield on the projecting ends of the resistance.

BRIEF DESCRIPTION OF THE DRAWINGS

The characteristics and advantages of the invention will become apparent from the description which follows, by way of non-limiting example, with reference to the accompanying drawings, in which.

DETAILED DESCRIPTION OF THE INVENTION

Figure 1:
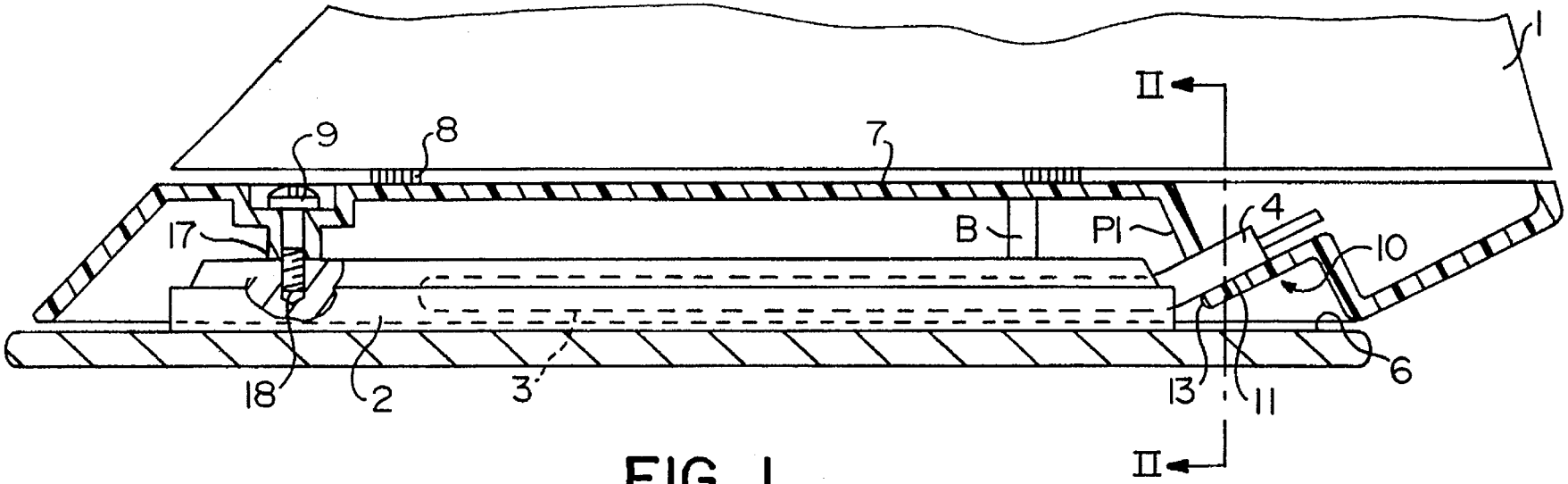
FIG. 1 is a fragmentary schematic view of a pressing iron showing in cross section the securement of a sole and a thermal shield according to the invention.

The pressing iron shown schematically in FIG. 1 comprises a casing 1 forming a handle and made of a plastic material which cannot resist very high temperatures, a pressing sole 2 cast of one piece generally aluminum and comprising a tubular heating resistance 3 of the hidden type of U shape which is embedded in the sole and whose ends

4 and 5 project from the upper surface 6 of the sole 2 in the rear region of the iron, as well as a thermal shield 7 interposed between the upper surface 6 and the casing 1 and maintained on said sole by securement means. This shield has the shape of an inverted shell and is made of a material resistant to high temperature for example a resin of the type sold under the trademark Bakelite.

The casing 1 is therefore insulated from the heating sole and is secured to the thermal shield 7 by any known means 8 such as screws or clips.

According to the invention, the securement means for the thermal shield 7 comprise, in the forward portion of the sole, an anchoring member 9 for the shield 7 to the sole and, in the rear portion of the sole, a hook means 10 for said shield on the projecting ends 4 and 5 of the resistance 3.

Thanks to this mounting of the shield on the sole, it will be understood that it will not be necessary to provide in the roar region either anchoring members such as screws or recesses or tongues provided on the sole and this while saving space to arrange electrical connections, whereby the cost of such a sole provided with a shield is reduced.

Figure 2:
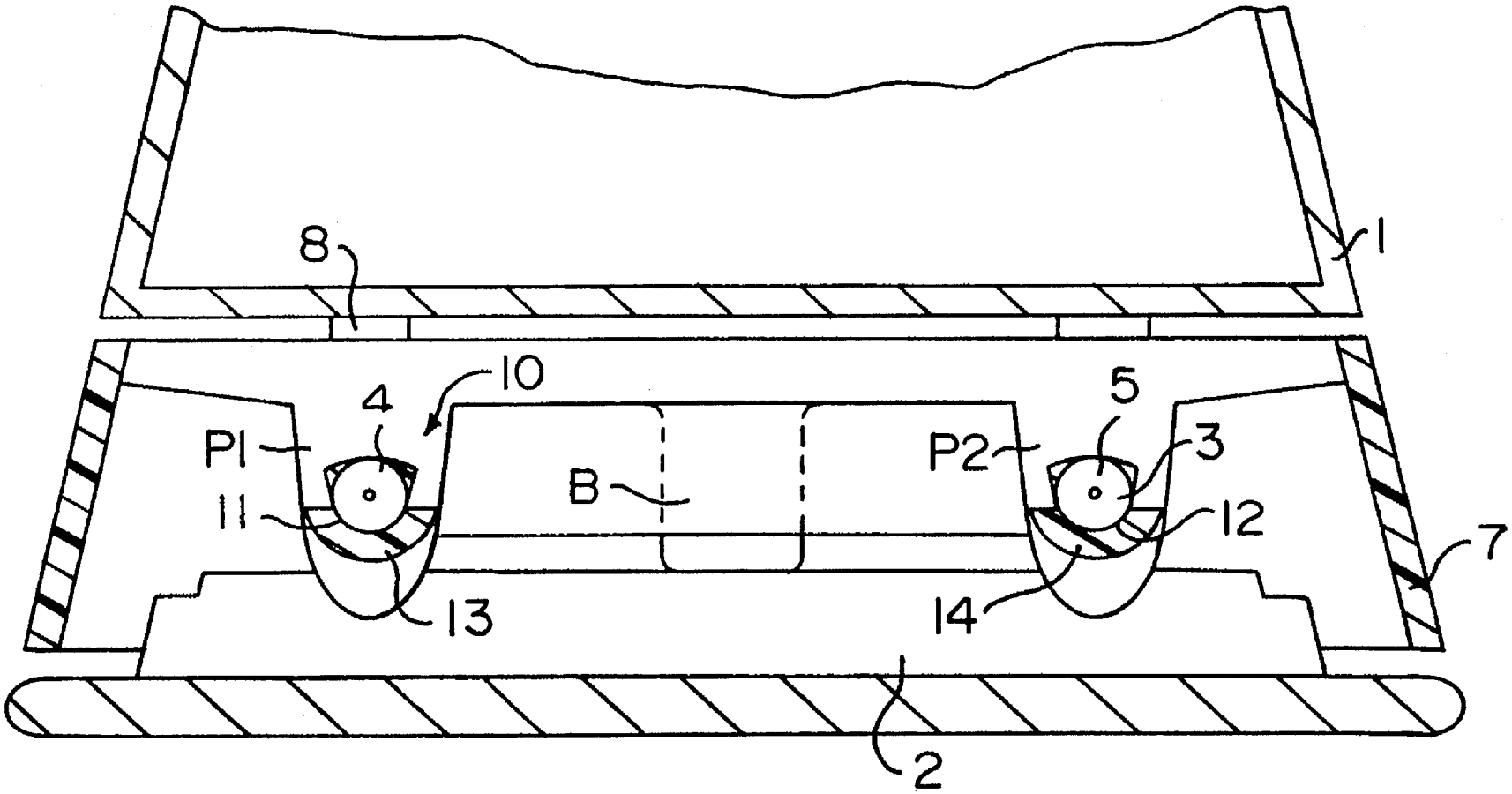
FIG. 2 is a cross-sectional view on the line II—II of FIG. 1.

As is seen better in FIG. 2, the hooking means 10 comprises tongues P1 and P2 which are integral with the shield 7 and directed toward the sole 2 and whose lower regions each comprise a hook having a friction bearing surface 11, 12 with the corresponding end 4, 5 of the tubular resistance 3.

In a preferred embodiment, the hooks are in the form of tubular guides 13, 14 provided in the tongue P1 and P2 of the thermal shield 7 and of which one region of the internal wall forms the bearing surfaces 11, 12 adapted to come into contact with the respective ends 4, 5 of the resistance.

So as to ensure better hooking of the shield 7 on the ends 4 and 5 of the resistance, the lower surface of the shield comprises a projection B which comes to bear against the sole between the member 9 and said ends so as to produce with the member 9 the effect of a lever between the forward and rear parts of the shield and particularly against the tongues P1 and P2 thereby drawing upwardly the bearing surfaces 11, 12 of the guides 13 and 14.

As shown in the drawings, the ends 4 and 5 of the resistance 3 project upwardly in an inclined direction relative to the upper horizontal surface 6 of the sole 2 and the tubular guides 13, 14 are also inclined so as to ensure good pressure on the bearing surfaces 11, 12.

Figure 3:
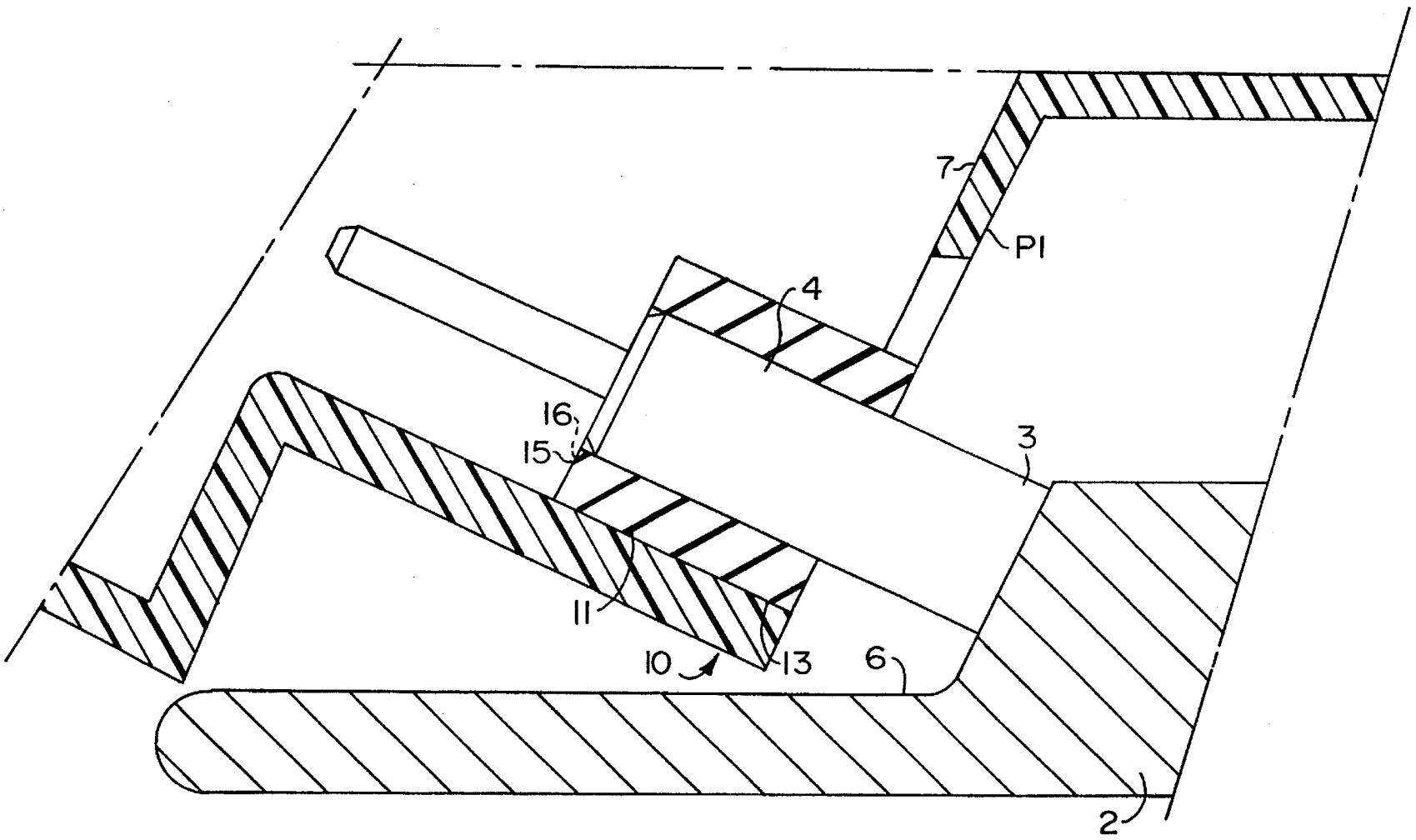
FIG. 3 is an enlarged view in vertical section of a modified embodiment of securement detail of the shield on the sole.

According to a modified embodiment shown in FIG. 3 and so as to improve the friction while taking up as needed the assembly play likely to arise during mass production, each end 4, 5 of the resistance comprises a sleeve 15, 16 of silicone which comes into engagement respectively with the bearing surface 11 and 12. Moreover, these silicone sleeves thermally isolate the shield 7 from these ends 4 and 5 which will be at high temperature.

So as to guarantee the correct positioning and the certain securement of the shield 7 on the sole 2, the anchoring member 9 is constituted of a screw which engages in a tapped bore 18 provided in the sole.

The head of this screw 9 comes into engagement with the upper outlet of a channel 17 integral with the shield and whose lower outlet bears against the sole 2.

Figure 4:
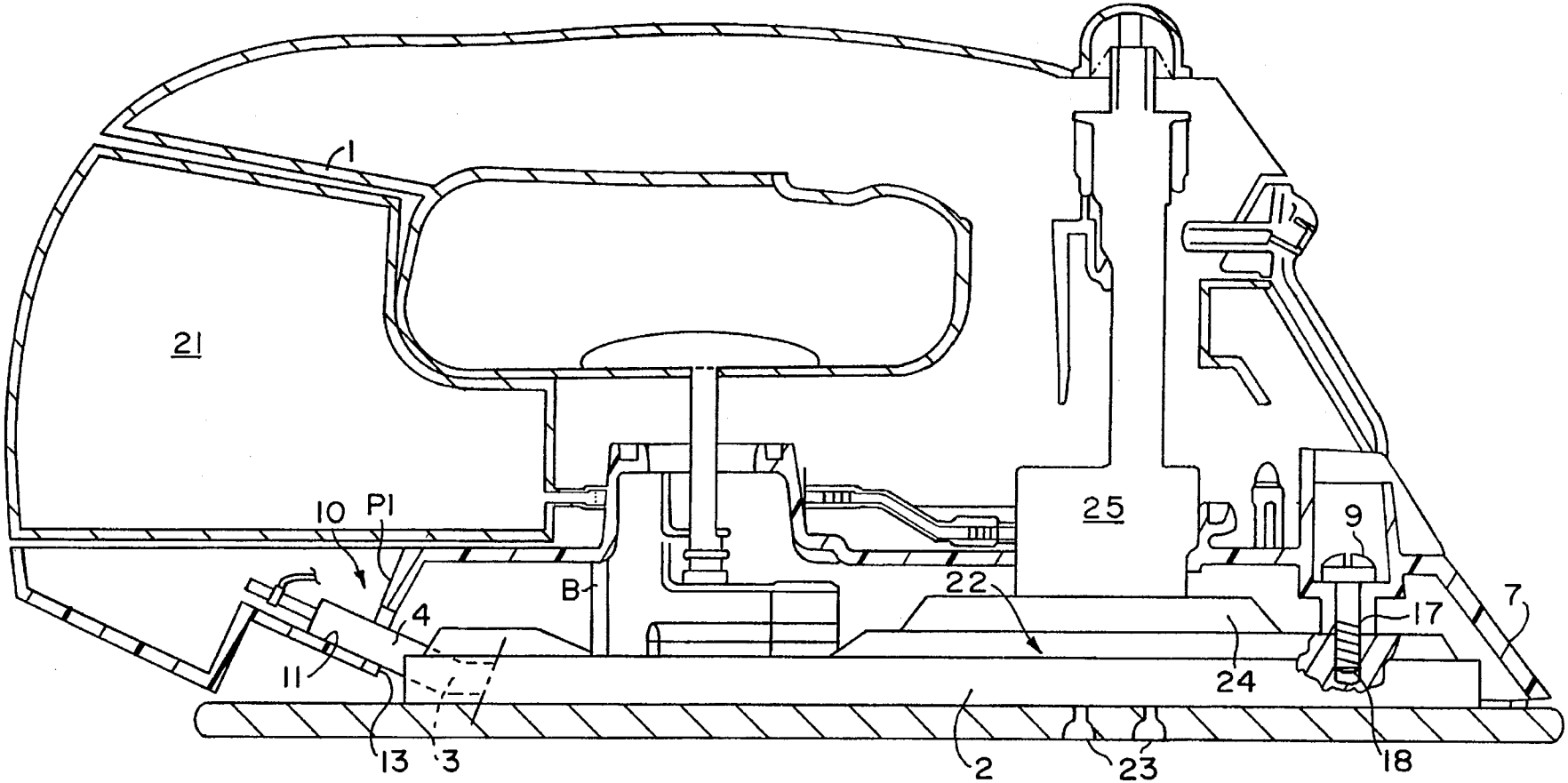
FIG. 4 shows in partial cross section and schematically a steam iron according to the invention.

As will be understood, the assembly of the shield 7 to the sole 2 such as described above with reference to a pressing iron of the dry type shown in FIG. 1, can also be applied to a steam iron as illustrated schematically in FIG. 4. For ease of reading the drawings, like members bear the same reference numerals as in FIGS. 1 to 3. This iron comprises a casing 1 enclosing a water reservoir 21 and a sole 2 which is heated by an embedded hidden resistance 3 comprising projecting ends of which a single one 4 is visible and which comprises a vaporization chamber 22 communicating with steam outlet openings 23 provided in the sole and covered by a cap 24 having an opening for a water supply device 25 (not shown) in said chamber.

The casing 1 is separated from the sole 2 by a thermal shield 7 having the same type of securement members, which is to say, anchoring member 0 and tubular guides 13, 14 provided in the shield 7.

Thus, whether it is the sole for a dry iron or a steam iron, the process of securement of the thermal shield 7 on the sole 2 is the same and consists in threading by translatory movement, from the rear portion toward the forward portion of the sole, the tubular guides 13 and 14 respectively on the ends 4 and 5 of the hidden resistance, then in ensuring the securement in correct position of the shield on the sole by the single anchoring member, such as a screw 9. Finally, the casing 1 is fixed on the shield 7 and completes the assembly of thereon.

This process could thus be automated in part and has the advantage of being simple and economical.

What is claimed is:

1. In a pressing iron comprising a casing (1), a pressing sole (2) comprising a heating resistance (3) which is embedded in the sole (2) and which has ends (4, 5) projecting from an upper surface of said sole (2) in the rear region of the iron, and a thermal shield (7) interposed between said upper surface of the sole and the casing, and maintained on said sole by securement means; the improvement wherein the securement means of the thermal shield (7) comprise, in the forward portion of the sole, an anchoring member (9) for anchoring the shield (7) to the sole (2) and, in the rear portion of the sole, a hooking device (10) for hooking the shield (7) on the projecting ends (4, 5) of the resistance (3).

2. A pressing iron according to claim 1, wherein the hooking device (10) comprises tongues (P1, P2) integral with the shield (7) and directed toward the sole and whose lower regions each comprise a hook having a friction bearing surface (11, 12) in contact with the corresponding end (4, 5) of the resistance.

3. A pressing iron according to claim 2, wherein the hooks are comprised by tubular guides (13, 14) provided on the tongues (P1, P2) of the thermal shield (7) and of which one region of the internal wall forms a friction bearing surface (11, 12) adapted to come into engagement with the respective ends (4, 5) of the resistance.

4. A pressing iron according to claim 3, wherein the ends (4, 5) of the resistance (3) project upwardly in an inclined direction relative to the upper surface (6) of the sole (2), and the tubular guides (13, 14) are also inclined.

5. A pressing iron according to claim 2, wherein each end of the resistance comprises a sleeve (15, 16) of silicone which comes into engagement with the friction bearing surfaces (11, 12).

6. A pressing iron according to claim 1, wherein, between the sole and the lower surface of the shield, there is interposed a projection (B) so as to obtain with the anchoring member (9) the effect of a lever between the forward and rear portions of the shield.

7. A pressing iron according to claim 1, wherein the anchoring member (9) of the shield (7) on the forward portion of the sole (2) is a screw (9) which comes into engagement with the sole (2).

8. A pressing iron according to claim 1, wherein the casing encloses a water reservoir (21) and the sole (2) comprises a vaporization chamber (24) communicating with steam outlet openings (23) provided in the sole (2), said casing being separated from the sole by the shield (7) which is secured by the anchoring member (9) and the hooking device (10).

9. A pressing for the production of a pressing iron, comprising threading by translatory movement tubular guides (13, 14) on a thermal shield (7) onto projecting ends (4, 5) of an electric resistance embodied in a sole of the iron, then securing in correct position the shield (7) on said sole (2) by an anchoring member (9) located in the forward region of the sole (2).

10. A pressing iron produced by the method of claim 9.

* * * * *